US012383782B2

(12) United States Patent
Hinton

(10) Patent No.: US 12,383,782 B2
(45) Date of Patent: Aug. 12, 2025

(54) EXERCISE SLED

(71) Applicant: Shannon Peter Hinton, Manly (AU)

(72) Inventor: Shannon Peter Hinton, Manly (AU)

( * ) Notice: Subject to any disclaimer, the term of this patent is extended or adjusted under 35 U.S.C. 154(b) by 83 days.

(21) Appl. No.: 18/552,689

(22) PCT Filed: Apr. 1, 2021

(86) PCT No.: PCT/AU2021/050308
§ 371 (c)(1),
(2) Date: Sep. 27, 2023

(87) PCT Pub. No.: WO2022/204748
PCT Pub. Date: Oct. 6, 2022

(65) Prior Publication Data

US 2024/0366988 A1 Nov. 7, 2024

(51) Int. Cl.
*A63B 21/06* (2006.01)
*A63B 21/00* (2006.01)
(Continued)

(52) U.S. Cl.
CPC ..... *A63B 21/0618* (2013.01); *A63B 21/0004* (2013.01); *A63B 21/0442* (2013.01);
(Continued)

(58) Field of Classification Search
CPC ..... A63B 21/0004; A63B 21/0442; A63B 21/0618; A63B 21/4015; A63B 21/4017;
(Continued)

(56) References Cited

U.S. PATENT DOCUMENTS 5,870,774 A * 2/1999 Legenstein ..... A41D 13/0568 2/24
6,582,347 B2 6/2003 Smith
(Continued)

FOREIGN PATENT DOCUMENTS

CA 2434904 A1 1/2005

OTHER PUBLICATIONS

PCT International Search Report for corresponding International Application Serial No. PCT/AU2021/050308, dated Jun. 29, 2021, pp. 1-3.

*Primary Examiner* — Megan Anderson
(74) *Attorney, Agent, or Firm* — Tarolli, Sundheim, Covell & Tummino LLP

(57) ABSTRACT

An exercise sled (10) for performing a core strengthening exercise routine has a load bearing body (12) with a bottom (14) configured to slide on a ground surface by pushing or pulling by a person performing the exercise routine, a front end which has wall portions (24, 26) for receiving the hands, knees or feet of the person, a rear end which has wall portions (28) for receiving the feet of the person, an intermediate region (20) which has an elevated portion (30) separating a first ramp portion (32) from a second ramp portion (34). Each of the first and second ramp portions has a forward facing ramp surface (36) and a rearward facing ramp surface (38). A first open recess (40, 42) is located between the wall portions at the front end and the forward facing ramp surfaces. A second open recess (44) is located between the wall portions at the rear end and the rearward facing ramp surfaces.

10 Claims, 10 Drawing Sheets

(51) Int. Cl.

| | |
|---|---|
| ***A63B 21/04*** | (2006.01) |
| ***A63B 22/20*** | (2006.01) |
| ***A63B 23/02*** | (2006.01) |
| ***A63B 23/035*** | (2006.01) |

(52) U.S. Cl.
CPC ..... *A63B 21/4015* (2015.10); *A63B 21/4033* (2015.10); *A63B 22/20* (2013.01); *A63B 21/4017* (2015.10); *A63B 23/02* (2013.01); *A63B 23/035* (2013.01); *A63B 2208/0219* (2013.01); *A63B 2208/0295* (2013.01)

(58) Field of Classification Search
CPC ... A63B 21/4033; A63B 22/20; A63B 23/035; A63B 2208/0219; A63B 2208/0295
See application file for complete search history.

(56) References Cited

U.S. PATENT DOCUMENTS

| | | | | |
|---|---|---|---|---|
| 6,626,807 | B1 | 9/2003 | Richmond | |
| 7,972,251 | B2 * | 7/2011 | Peddar | A63B 21/4035 482/140 |
| 9,370,681 | B2 | 6/2016 | Chang | |
| 2009/0305853 | A1 * | 12/2009 | Jordan | A63B 22/20 434/258 |
| 2010/0317496 | A1 | 12/2010 | Abranchess | |
| 2016/0287932 | A1 | 10/2016 | Brown | |
| 2017/0282008 | A1 * | 10/2017 | Williams | A63B 69/002 |

* cited by examiner

EXERCISE SLED

TECHNICAL FIELD

The present invention relates to an exercise sled and, in particular, to a sled for use in exercises that develop the core strength of a person.

BACKGROUND

Exercise sleds are known and have been used to build strength and stamina in athletes who participate in a range of sports, from sprinting to endurance and body contact sport.

Normally, these known exercise sleds are designed and built with a specific exercise routine in mind, and so they enable an athlete to develop only certain muscles in a localized region of the body, normally the legs, arms or shoulders.

It is, therefore, an object of the present invention to provide an exercise sled which may be utilized by a person to perform many different exercise routines that can stimulate the development of musculature in and around the core of the person's body, or at least provides a useful alternative to known exercise sleds.

SUMMARY OF INVENTION

According to the present invention, there is provided an exercise sled for performing a core strengthening exercise routine, the exercise sled comprising a load bearing body having a bottom which is configured to slide on a ground surface by pushing or pulling by a person performing the exercise routine, a front end which has wall portions for receiving the hands, knees or feet of the person, a rear end which has wall portions for receiving the feet of the person, an intermediate region between the front and rear ends and which has an elevated portion separating a first ramp portion at a first side of the intermediate region from a second ramp portion at a second side of the intermediate region, wherein each of the first and second ramp portions has a forward facing ramp surface and a rearward facing ramp surface, and wherein a first open recess is located between the wall portions at the front end and the forward facing ramp surfaces, and a second open recess is located between the wall portions at the rear end and the rearward facing ramp surfaces.

Preferably, the wall portions at the front end comprise a pair of wall portions.

It is also preferred that the wall portions at the rear end comprise a single continuous wall.

In a preferred form, the rearward facing ramp surface is steeper than the forward facing ramp surface.

The intermediate region preferably has a rear surface which has two openings separated by a wall section, the openings having internal passageways which are interconnected.

The front end preferably has a front surface which has two openings separated by a wall section, the openings having internal passageways which are interconnected.

In another preferred form, the exercise sled further comprises an elastically stretchable line which forms a loop around the wall section of either the rear surface or the front surface after the elastically stretchable line is fed into one of the openings and then exits from the other opening, and the elastically stretchable line has free ends which are connected together around an external anchor point.

The exercise sled may further comprise a pair of foot straps attached to the rearward facing ramp surfaces.

The exercise sled may further comprise an opening in one or each of the rearward facing ramp surfaces for inserting into the or each opening a required weight to increase the load of the load bearing body.

There has been thus outlined, rather broadly, the more important features of the invention in order that the detailed description thereof that follows may be better understood and put into practical effect, and in order that the present contribution to the art may be better appreciated.

There are additional features of the invention that will be described hereinafter. As such, those skilled in the art will appreciate that the conception, upon which the disclosure is based, may be readily utilized as the basis for designing other structures, assemblies, process steps and system configurations for carrying out the object of the present invention. It is important, therefore, that the broad outline of the invention described above be regarded as including such equivalent features insofar as they do not depart from the spirit and scope of the present invention.

DETAILED DESCRIPTION OF THE INVENTION

Figure 2:
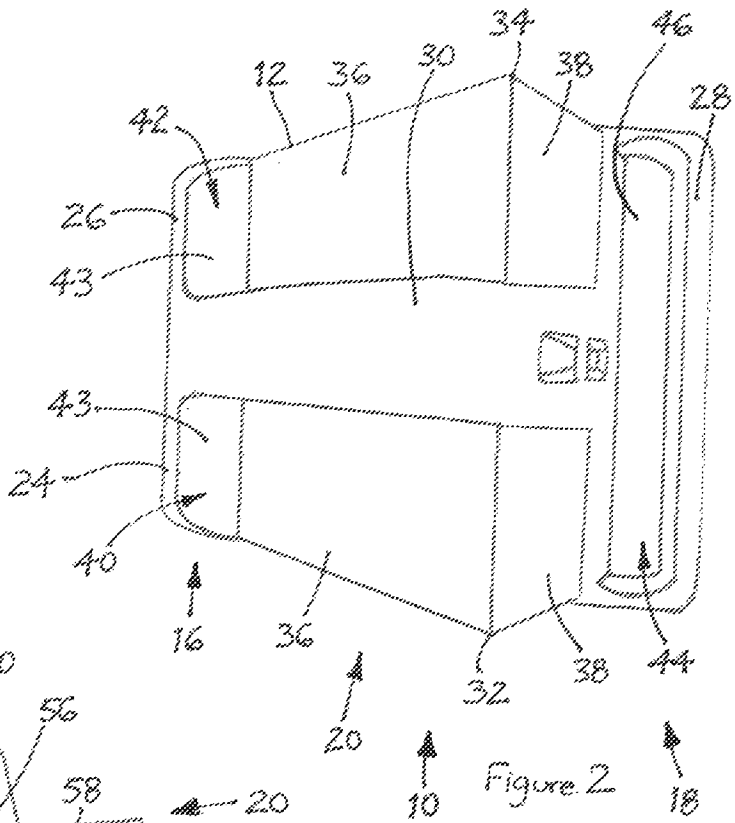
FIG. 2 is a top view of the exercise sled shown in FIG. 1.
Figure 1:
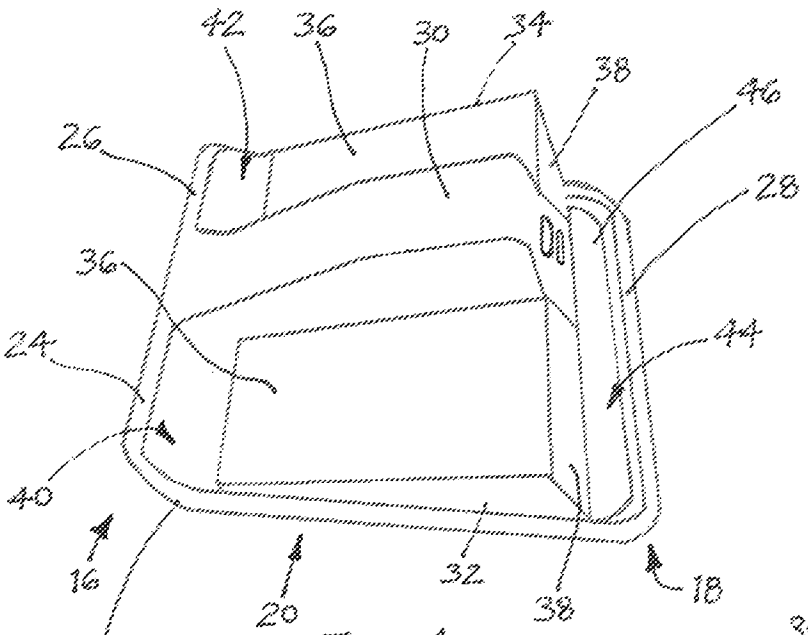
FIG. 1 is a side perspective view of an exercise sled according to a preferred embodiment of the present invention.
Figure 3:
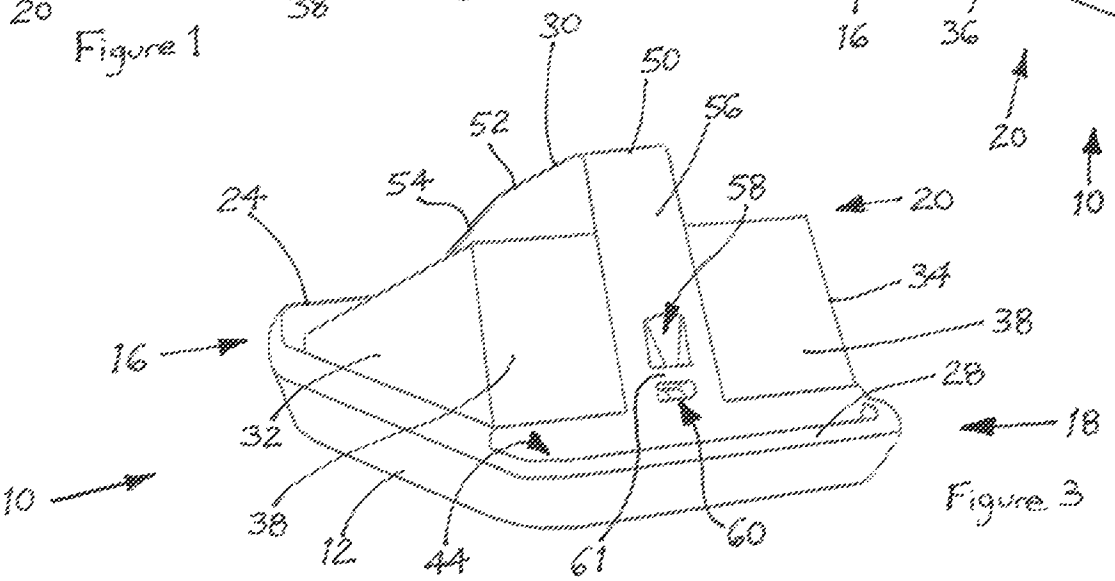
FIG. 3 is a rear perspective view of the exercise sled shown in FIG. 1.
Figure 4:
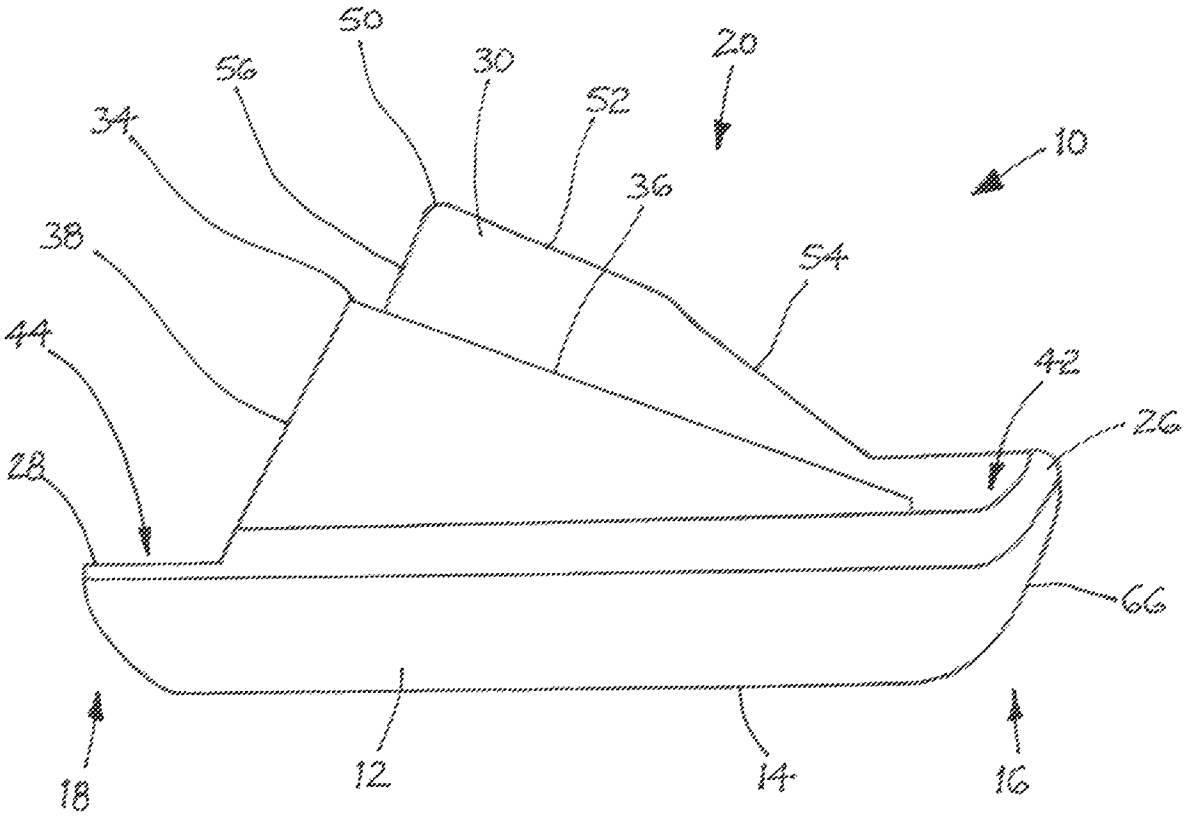
FIG. 4 is a side elevation view of the exercise sled shown in FIG. 1.
Figure 5:
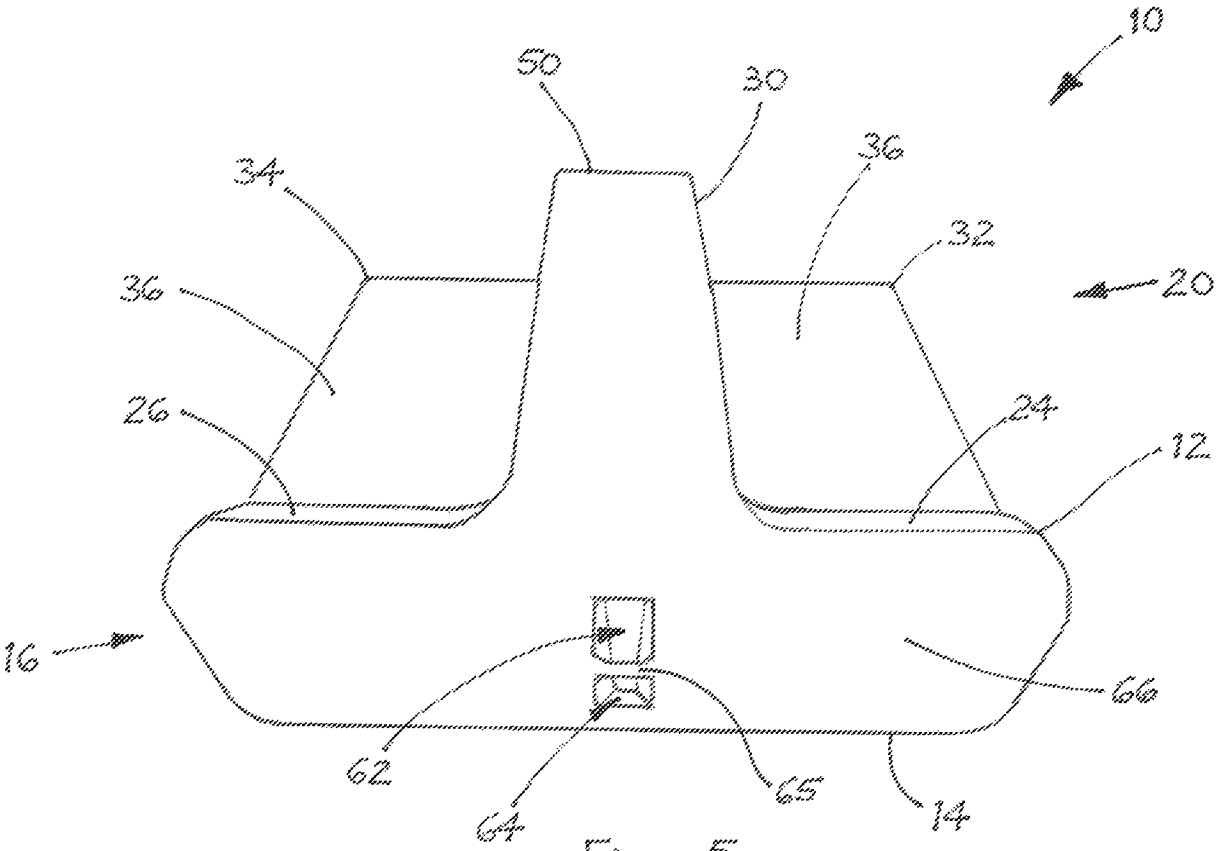
FIG. 5 is a front view of the exercise sled shown in FIG. 1.
Figure 6:
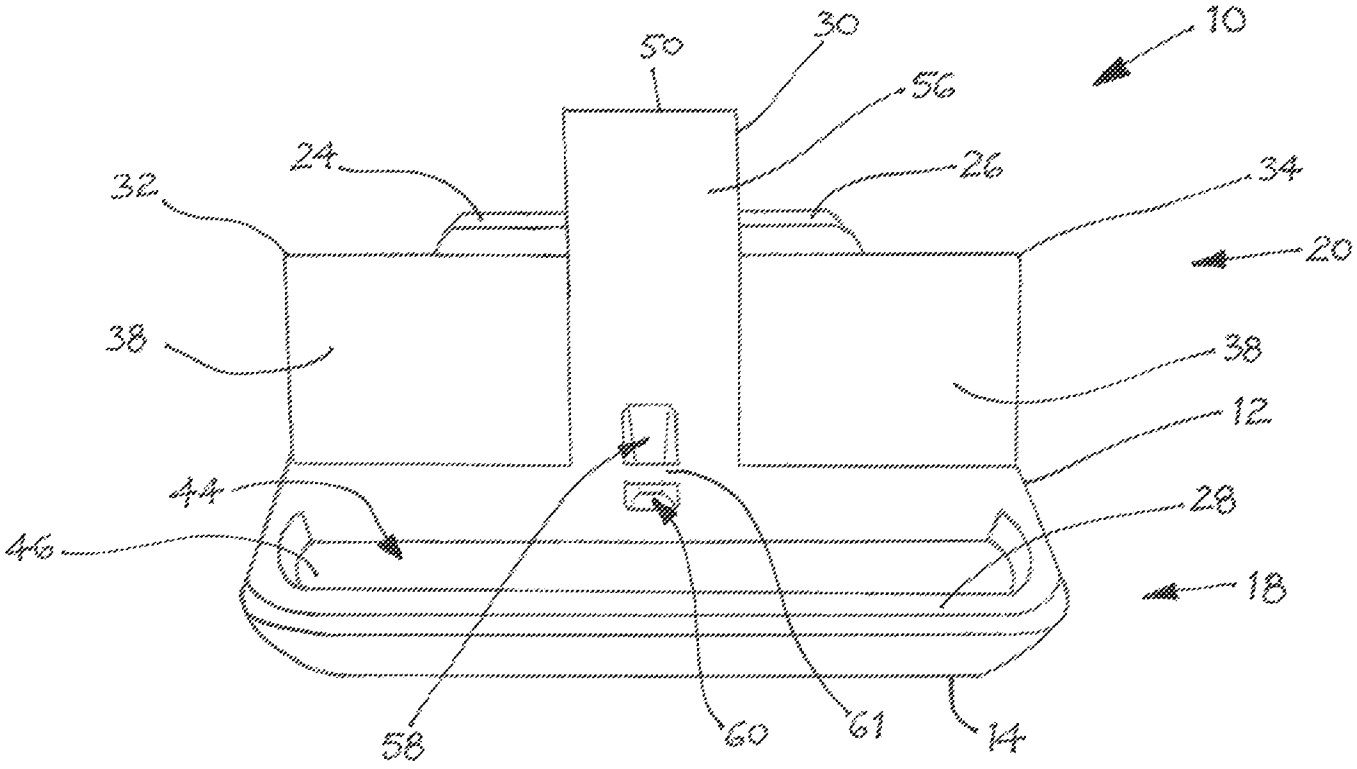
FIG. 6 is a rear view of the exercise sled shown in FIG. 1.

The exercise sled 10 shown in FIGS. 1 to 17 comprises a load bearing body 12 with a bottom 14, a front end 16, a rear end 18 and an intermediate region 20 between the front end 16 and the rear end 18.

The bottom 14 is configured to slide on a ground surface by pushing or pulling the exercise sled 10 by a person 22 performing an exercise routine. The surface of the bottom 14 has a level of frictional engagement or resistance with the ground surface which is suitable for the type of exercise routine to be performed. The load of the load bearing body 12 comprises the weight of the body 12 and the level of frictional engagement or resistance with the ground surface.

The front end 16 has a pair of walls, each wall comprising wall portions 24, 26 for receiving the hands, knees or feet of the person 22. In an alternative embodiment, the front end has a single continuous wall and spaced-apart wall portions of that single continuous wall are adapted to be received by the hands, knees or feet of the person 22.

The rear end 18 has a single continuous wall 28 and spaced-apart wall portions of that single continuous wall 28 are adapted to be received by the feet of the person 22. In an alternative embodiment, the rear end has a pair of walls, each wall comprising wall portions for receiving the feet of the person 22.

The intermediate region 20 has an elevated portion 30 separating a first ramp portion 32 at a first side of the intermediate region from a second ramp portion 34 at a second side of the intermediate region.

The ramp portions 32, 34 are identical in shape, size and orientation, and each ramp portion has a forward facing ramp surface 36 and a rearward facing ramp surface 38. In this embodiment, the rearward facing ramp surfaces 38 are steeper than the forward facing ramp surfaces 36, and so the rearward facing ramp surfaces 38 are ideally used as the surfaces against which the undersides of a person's feet can be pressed so as to push the exercise sled 10 in a core strengthening movement of an exercise routine. Although much less steep, the forward facing ramp surfaces 36 can also be used for this purpose, but in a manner which will be described later with reference to FIGS. 15 and 16. In this embodiment, each of the forward facing ramp surfaces 36 is at an angle of about 20° to the horizontal, but may be of any suitable angle for the type of exercise routine to be performed, such as between about 10° and about 35° to the horizontal. In this embodiment, each of the rearward facing ramp surfaces 38 is at an angle of about 60° to the horizontal, but may be of any suitable angle for the type of exercise routine to be performed, such as between about 35° and about 90° to the horizontal.

In this embodiment, the ramp portions 32, 34 are permanently secured to the rest of the body 12, such as by being integrally formed during the forming of the entire body 12, or by being affixed to the rest of the body by screws, adhesive or other permanent fastening means.

In an alternative embodiment, the ramp portions 32, 34 are removably connected to the rest of the body 12 by any suitable clipping or sliding mechanisms, or by a combination of those mechanisms, or by any other suitable means that will allow ramp portions of a different size, shape and orientation to be used for the purpose of the type of exercise routine to be performed.

The exercise sled 10 can be utilized by the person 22 to perform many different exercise routines that can stimulate the development of musculature in and around the core of the person's body.

Each of the wall portions 24, 26 at the front end 16 are part of a respective first open recess 40, 42 which can also receive the hands, knees or feet of the person 22. Each first open recess 40, 42 is located between its wall portion 24, 26 and its adjacent forward facing ramp surface 36, and includes a floor 43.

The wall 28 at the rear end 18 is part of a second open recess 44 which can also receive the feet of the person 22. The second open recess 44 is formed between the wall 28 and its adjacent rearward facing ramp surfaces 38. The second open recess 44 includes a floor 46 for receiving the toes or heels of the feet.

In this embodiment, the rearward facing ramp surfaces 38 do not have anything attached to them, but in an alternative embodiment, a pair of foot straps are attached to the rearward facing ramp surfaces for receiving therethrough the feet of the person 22.

In another embodiment, the rearward facing ramp surfaces 38 include an opening for inserting into the body 12 a required weight to increase the load.

The elevated portion 30 of the intermediate region 20 slopes forwardly and downwardly from a high point 50 near the rear end 18 to the front end 16 through two consecutive angles, a first upper surface 52 of the elevated portion 30 having an angle which is not as steep as the angle of the second lower surface 54 of the elevated portion 30. The elevated portion 30 also slopes rearwardly and downwardly from the high point 50 to form a rear surface 56.

In this embodiment, the rear surface 56 has two openings 58, 60 which are separated by a wall section 61. The openings 58, 60 have internal passageways which are interconnected so that an elastically stretchable band, rope, tether or other such line can be fed into one of the openings and then exit the other opening, thereby forming a loop of the line around the wall section 61, after which the free ends of the elastically stretchable line are tied or otherwise connected together around an external anchor point.

Similar openings 62, 64, with interconnected internal passageways and a wall section 65 for engaging a similar elastically stretchable line and for connecting that line to an external anchor point, are provided, in this embodiment, in a front surface 66 at the front end 16 of the body 12.

In other embodiments, the openings 58, 60 and the openings 62, 64 are absent, or only one pair of openings is present.

The use of the exercise sled 10 will now be described with reference to FIGS. 7 to 17.

Figure 7:
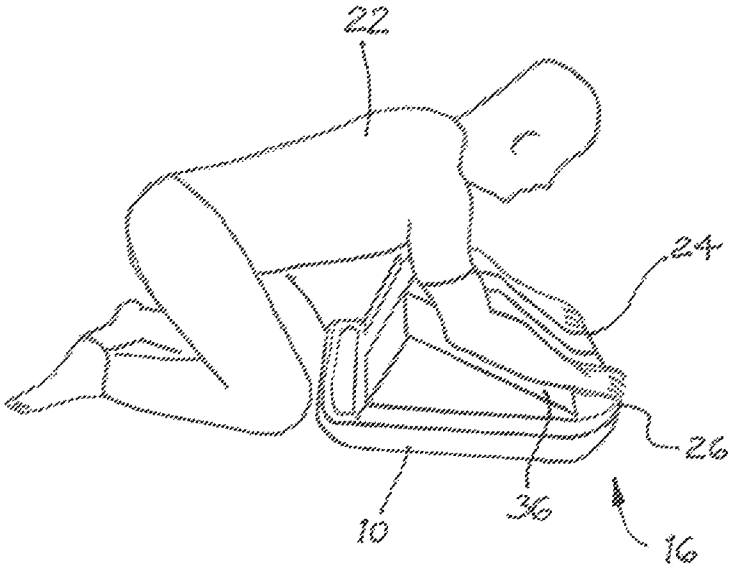
FIG. 7 is a view of a person kneeling behind, and bending over, the exercise sled of FIG. 1 with their forearms resting on the forward facing ramp surfaces and their hands gripping the front end of the exercise sled, in readiness to push the exercise sled forward in a first core strengthening movement of a first exercise routine.

As shown in FIG. 7, a person 22 is kneeling behind, and bending over, the exercise sled 10. Their forearms are resting on respective forward facing ramp surfaces 36 and their hands are gripping on respective wall portions 24, 26 at the front end 16 of the exercise sled 10. The person is ready to push the exercise sled 10 forward in a first core strengthening movement of a first exercise routine.

Figure 8:
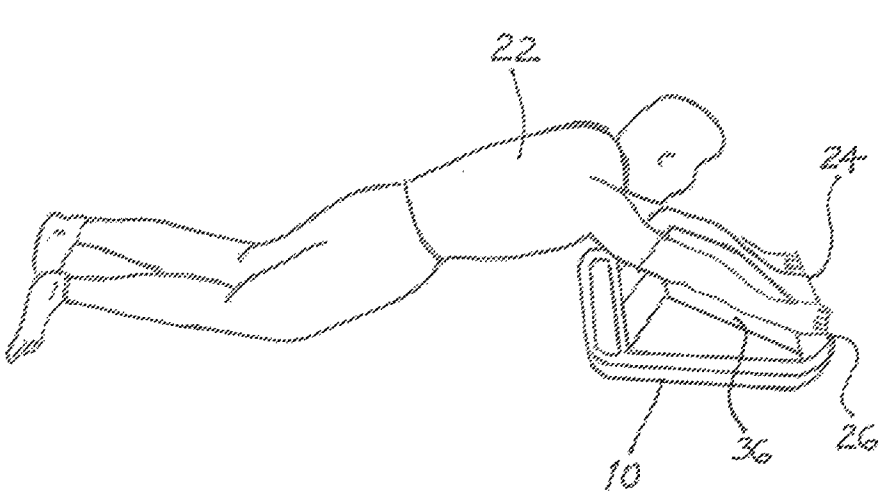
FIG. 8 is a view of the person shown in FIG. 7 after having fully extended their body forward to push the exercise sled to an intermediate position, so that the person lies outstretched and face down, their torso elevated from the ground surface, and their arms outstretched with their hands still gripping the front end, in readiness to perform a second core strengthening movement of the first exercise routine in which the person uses their core strength to pull the exercise sled backwards to again assume the kneeling and bending position shown in FIG. 7.

FIG. 8 shows the person 22 in FIG. 7 after having fully extended their body forward to push the exercise sled 10 to an intermediate position. The person lies outstretched and face down, their torso elevated from the ground surface, and their arms are outstretched with their hands still gripping the wall portions 24, 26 of the exercise sled 10. The person is ready to perform a second core strengthening movement of the first exercise routine in which the person, with their hands still gripping the wall portions 24, 26, uses their core strength to pull the exercise sled backwards to again assume the kneeling and bending position shown in FIG. 7.

Figure 9:
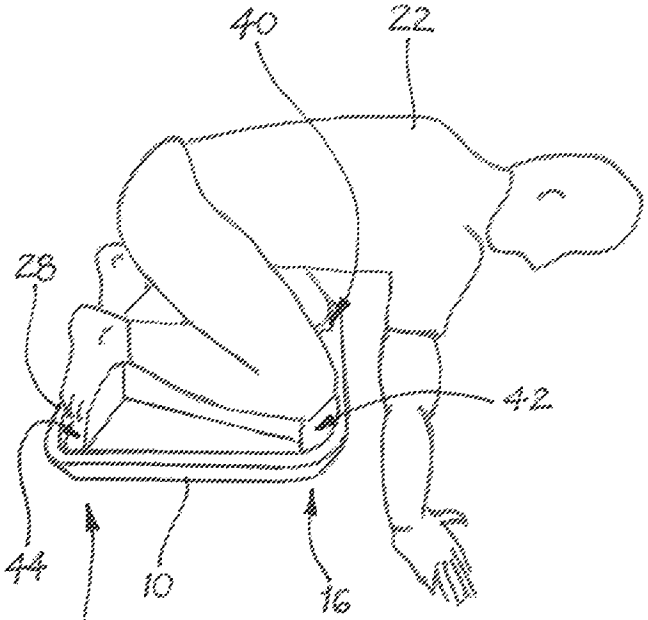
FIG. 9 is a view of a person kneeling on, and bending towards, the front of the exercise sled of FIG. 1 with their feet on the rear end and their knees on the front end of the exercise sled, and with their hands to the side thereof, in readiness to stretch their body forward in a first core strengthening movement of a second exercise routine.

As shown in FIG. 9, a person 22 is kneeling on, and bending towards, the front of the exercise sled 10. The toes of their feet are in the open recess 44 and pressed against the wall 28 at the rear end 18 and their knees are resting in the open recesses 40, 42 at the front end 16 of the exercise sled 10. Their arms are outstretched with their hands planted on the ground surface. The person is ready to stretch their body forward in a first core strengthening movement of a second exercise routine.

Figure 10:
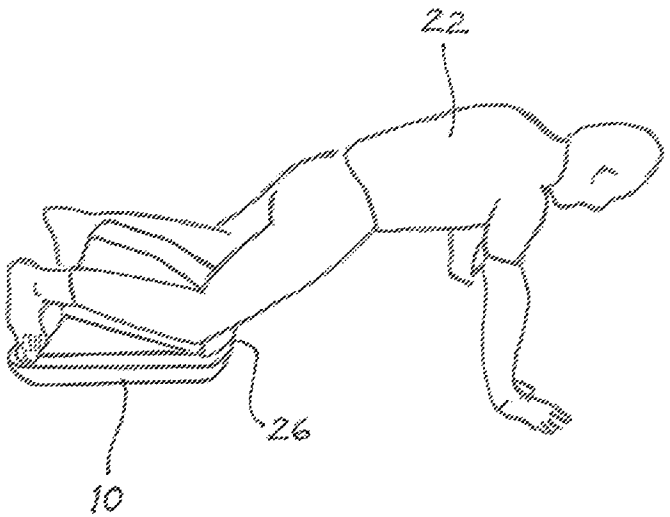
FIG. 10 is a view of the person shown in FIG. 9 after having fully extended their body away from the exercise sled to an intermediate position, so that the person lies outstretched and face down, their torso elevated from the ground surface, and their arms outstretched with their hands planted on the ground surface, in readiness to perform a second core strengthening movement of the second exercise routine in which the person uses their core strength to push the exercise sled forward to again assume the kneeling and bending position shown in FIG. 9.

FIG. 10 shows the person 22 in FIG. 9 after having fully extended their body away from the exercise sled 10 to an intermediate position. The person lies outstretched and face down, their torso elevated from the ground surface, and their arms are outstretched with their hands planted on the ground surface. The person is ready to perform a second core strengthening movement of the second exercise routine in which the person, with their knees still in the open recesses 40, 42 but now pressed against the wall portions 24, 26, uses their core strength to push the exercise sled 10 forward to again assume the kneeling and bending position shown in FIG. 9.

The second exercise routine described above with reference to FIGS. 9 and 10 results in the person 22 moving progressively forward with each repetition of the routine. However, a variation of the second exercise routine allows the person to remain in a stationary position by ensuring that their hands remain planted on the ground surface so that the lower body pushes the exercise sled 10 backward and forward, in a repetitive manner.

Figure 11:
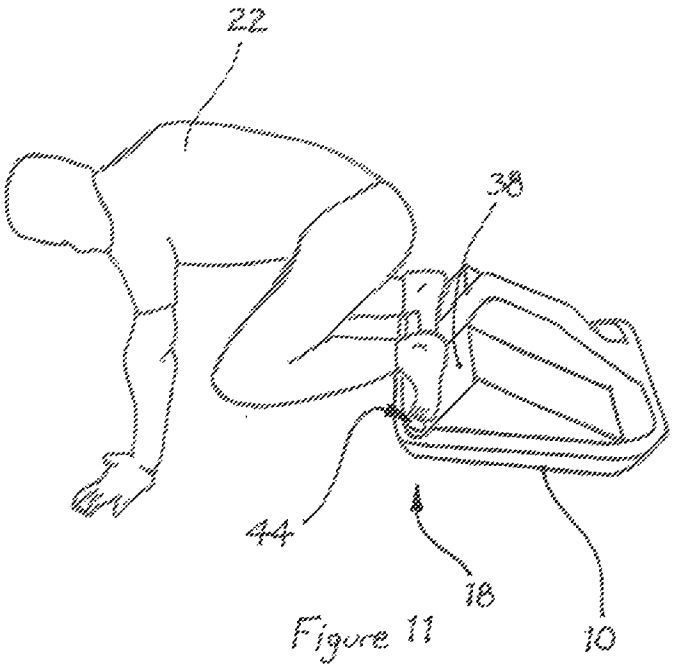
FIG. 11 is a view of a person crouching on, and bending away from, the rear end of the exercise sled of FIG. 1 with their feet on the rear end of the exercise sled and their arms outstretched with their hands planted on the ground surface, in readiness to push the exercise sled rearwardly in a first core strengthening movement of a third exercise routine.

As shown in FIG. 11, a person 22 is crouching on, and bending away from, the rear end 18 of the exercise sled 10. The toes of their feet are in the open recess 44 and the soles of their feet are pressed against the rearward facing ramp surfaces 38 at the rear end 18 of the exercise sled 10. Their arms are outstretched with their hands planted on the ground surface. The person is ready to push the exercise sled 10 rearwardly in a first core strengthening movement of a third exercise routine.

Figure 12:
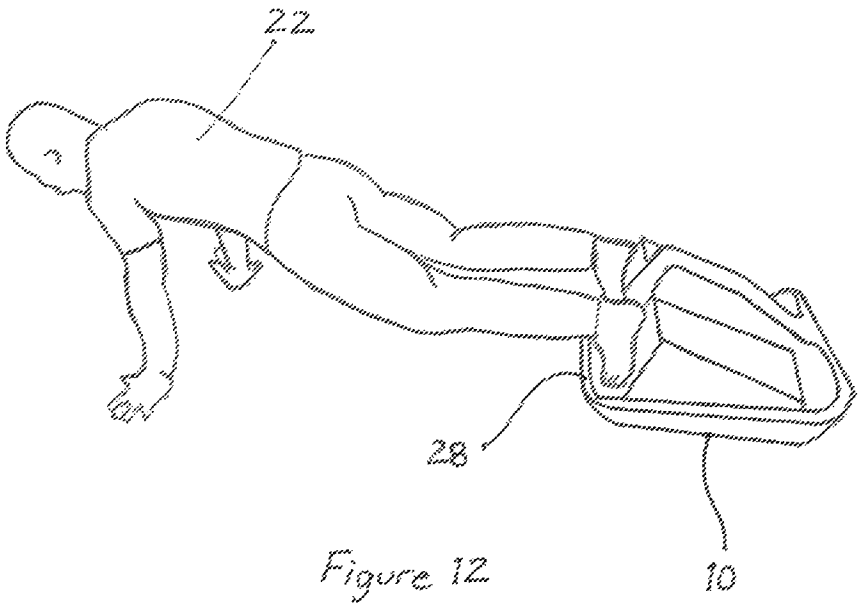
FIG. 12 is a view of the person shown in FIG. 11 after having fully extended their body rearwardly to push the exercise sled to an intermediate position, so that the person lies outstretched and face down, their torso elevated from the ground surface, and their arms outstretched with their hands still planted on the ground surface, in readiness to perform a second core strengthening movement of the third exercise routine in which the person uses their core strength to pull the exercise sled forward to again assume the crouching and bending position shown in FIG. 11.

FIG. 12 shows the person 22 in FIG. 11 after having fully extended their body rearwardly to push the exercise sled 10 to an intermediate position. The person lies outstretched and face down, their torso elevated from the ground surface, and their arms are outstretched with their hands still planted on the ground surface. The person is ready to perform a second core strengthening movement of the third exercise routine in which the person, with their toes still in the open recess 44 but now pressed against the wall 28, uses their core strength to pull the exercise sled 10 forward to again assume the crouching and bending position shown in FIG. 11.

Figure 13:
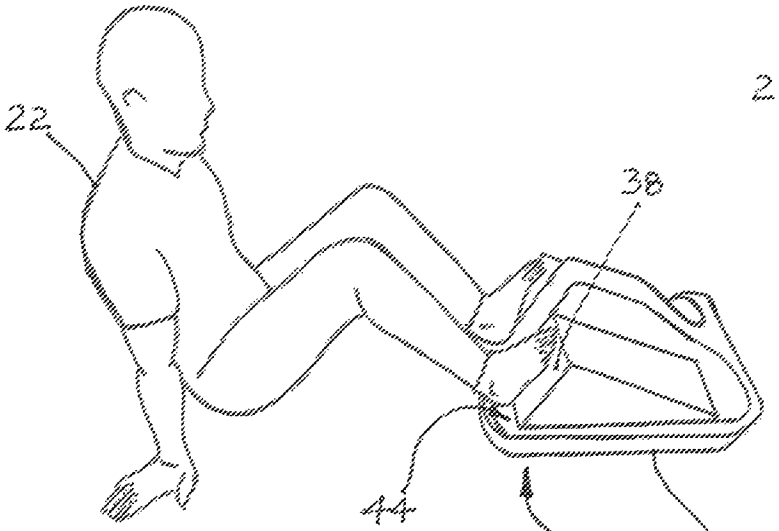
FIG. 13 is a view of a person with the underside of their feet pressed against the rearward facing ramp surfaces of the exercise sled of FIG. 1, positioned with bent knees and upright torso elevated from the ground surface, and their arms outstretched with their hands planted on the ground surface, in readiness to push the exercise sled forward in a first core strengthening movement of a fourth exercise routine.

As shown in FIG. 13, a person 22 has the heels of their feet in the open recess 44 and the soles of their feet are pressed against the rearward facing ramp surfaces 38 at the rear end 18 of the exercise sled 10. The person is positioned with bent knees and upright torso elevated from the ground surface, and their arms are outstretched with their hands planted on the ground surface. The person is ready to push the exercise sled 10 forward in a first core strengthening movement of a fourth exercise routine.

Figure 14:
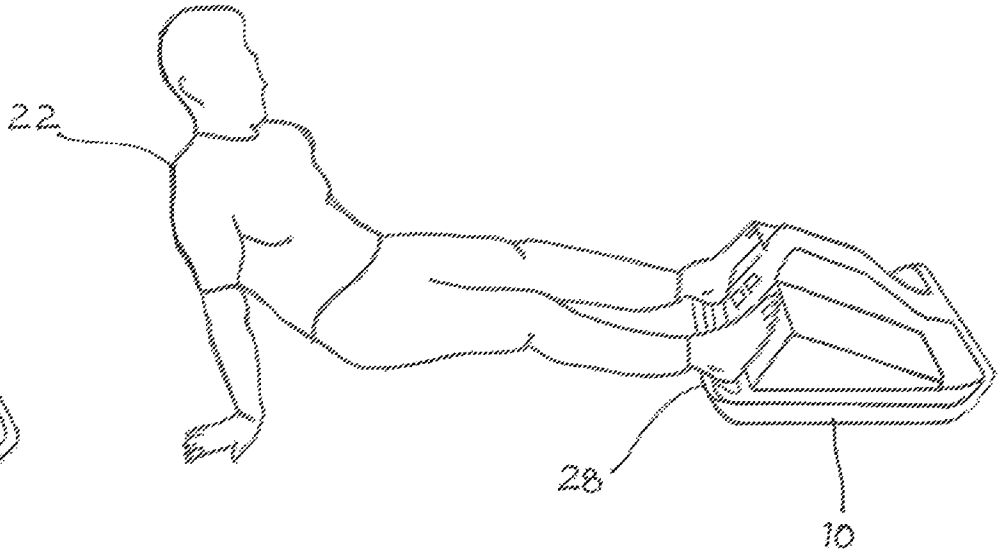
FIG. 14 is a view of the person shown in FIG. 13 after having fully extended their body forward to push the exercise sled to an intermediate position, so that the person lies outstretched and face up, their torso elevated from the ground surface, and their arms outstretched with their hands still planted on the ground surface, in readiness to perform a second core strengthening movement of the fourth exercise routine in which the person uses their core strength to pull the exercise sled rearwardly to again assume the bent knees position shown in FIG. 13.

FIG. 14 shows the person 22 in FIG. 13 after having fully extended their body forward to push the exercise sled 10 to an intermediate position. The person lies outstretched and face up, their torso elevated from the ground surface, and their arms are outstretched with their hands still planted on the ground surface. The person is ready to perform a second core strengthening movement of the fourth exercise routine in which the person, with their heels still in the open recess 44 but now pressed against the wall 28, uses their core strength to pull the exercise sled 10 rearwardly to again assume the bent knees position shown in FIG. 13.

Figure 15:
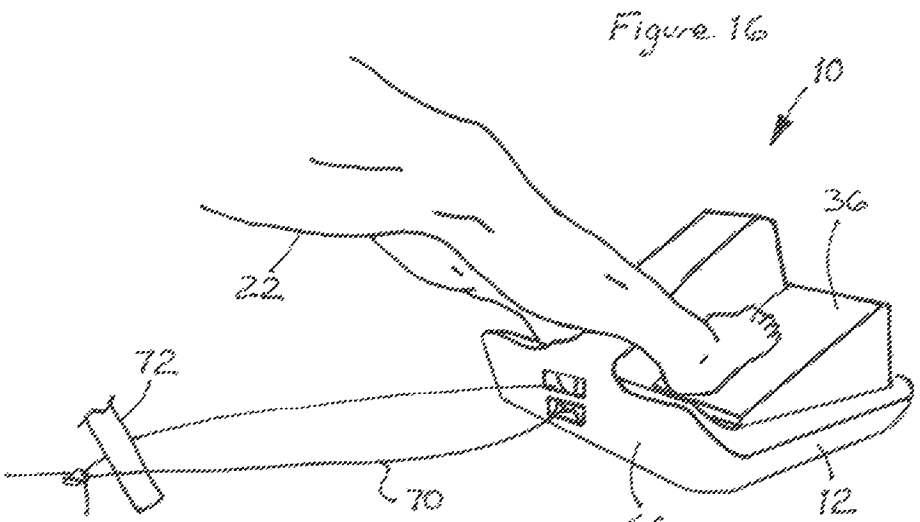
FIG. 15 is a partial view of a person with the underside of their feet pressed against the forward facing ramp surfaces of the body of the exercise sled of FIG. 1, the person having the same starting body position as shown in FIG. 13, and an increased load is provided by connecting the body of the exercise sled to an elastically stretchable line which is anchored to an anchor point, in readiness to push the exercise sled forward in a first core strengthening movement of a fifth exercise routine.

As shown in FIG. 15, a person 22 has the heels of their feet in the open recesses 40, 42 and the soles of their feet are pressed against the forward facing ramp surfaces 36 at the front end 16 of the body 12 of the exercise sled 10.

Otherwise, the person may assume the same starting body position as shown in FIG. 13, namely, the position with bent knees and upright torso elevated from the ground surface, and their arms are outstretched with their hands planted on the ground surface, or may assume some other similar starting body position.

An elastically stretchable line 70 is looped through the openings 62, 64 and around the wall section 61 in the front surface 66 of the body 12 and the free ends of the line 70 are connected together around an external anchor point 72. An increased load is provided by so connecting the body 12 of the exercise sled 10 to the elastically stretchable line 70 which is anchored at its opposite end to the anchor point 72. The person 22 is ready to push the body of the exercise sled 10 forward, and so elastically stretch the line 70, in a first core strengthening movement of a fifth exercise routine.

Figure 16:
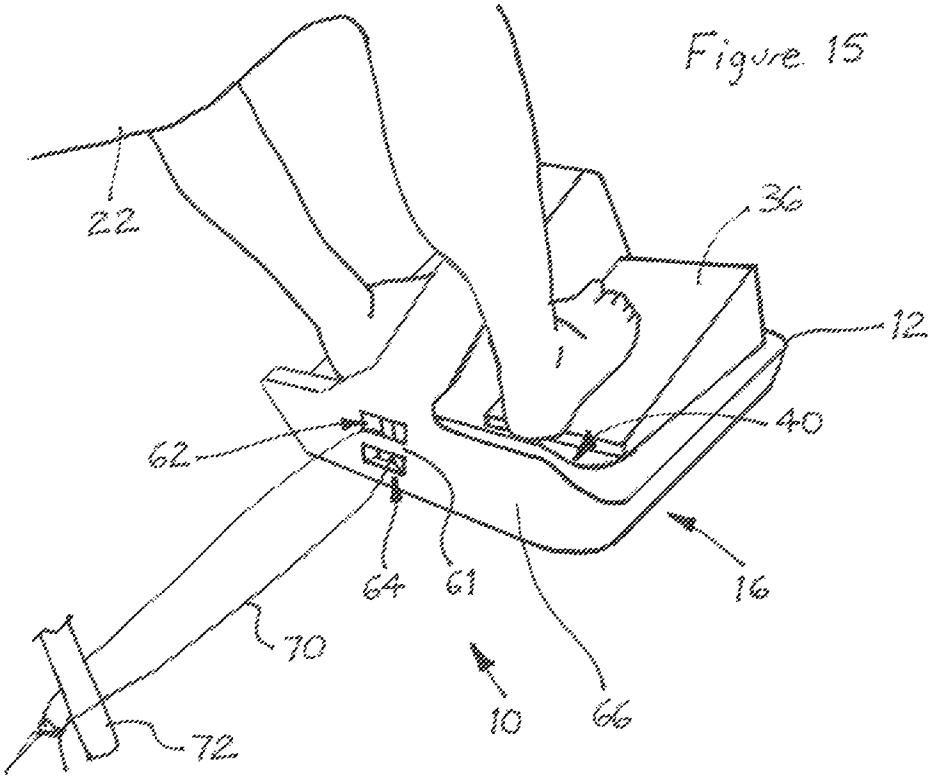
FIG. 16 is a partial view of the person shown in FIG. 15 after having fully extended their body forward to push the body of the exercise sled to a forward position, the person having the same body position as shown in FIG. 14, in readiness to release their extended leg pressure without lifting their feet from the forward facing ramp surfaces so that the stretched line can retract, bringing the body of the exercise sled sliding back towards the person so that the person can repeat the exercise routine.

FIG. 16 shows the person 22 in FIG. 15 after having fully extended their body forward to push the body 12 of the exercise sled 10 to a forward position. The person can release their extended leg pressure without lifting their feet from the forward facing ramp surfaces 36, which will allow the stretched line 70 to retract, bringing the body of the exercise sled 10 sliding back towards the person so that the person can again assume the same, or a similar, starting body position for repeating the exercise routine.

Figure 17:
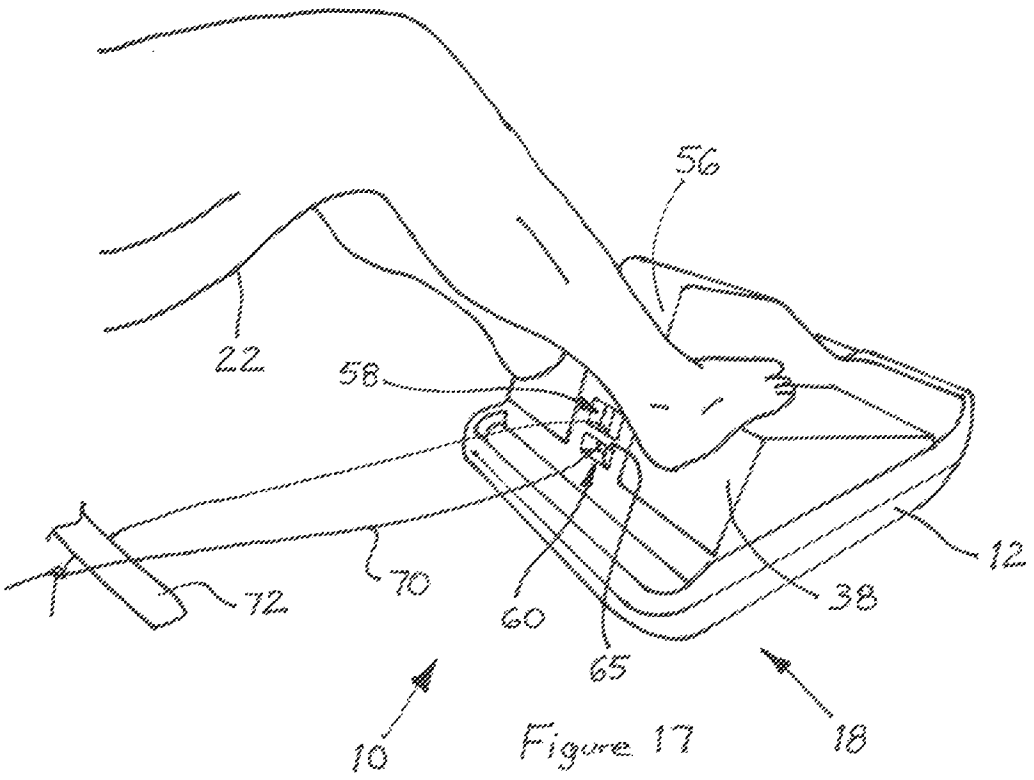
FIG. 17 is a partial view of a person with the underside of their feet pressed against the rearward facing ramp surfaces of the body of the exercise sled of FIG. 1, the person having the same starting body position as shown in FIG. 13, and an increased load is provided by connecting the body of the exercise sled to an elastically stretchable line which is anchored to an anchor point, in readiness to push the exercise sled forward in a first core strengthening movement of a sixth exercise routine.

As shown in FIG. 17, a person 22 has the heels of their feet pressed against the rearward facing ramp surfaces 38 at the rear end 18 of the body 12 of the exercise sled 10. Otherwise, the person may assume the same starting body position as shown in FIG. 13, namely, the position with bent knees and upright torso elevated from the ground surface, and their arms are outstretched with their hands planted on the ground surface, or may assume some other similar starting body position.

An elastically stretchable line 70 is looped through the openings 58, 60 and around the wall section 65 in the rear surface 56 of the body 12 and the free ends of the line 70 are connected together around an external anchor point 72 so as to increase the load. The person 22 is ready to push the body of the exercise sled 10 forward, and so elastically stretch the line 70, in a first core strengthening movement of a sixth exercise routine.

When the body 12 of the exercise sled 10 has been pushed to a forward position, the person can release their extended leg pressure without lifting their feet from the rearward facing ramp surfaces 38, which will allow the stretched line 70 to retract, bringing the body of the exercise sled 10 sliding back towards the person so that the person can again assume the same, or a similar, starting body position for repeating the exercise routine.

It will also be readily apparent to persons skilled in the art that various modifications may be made in details of the design and construction of the above embodiment of the exercise sled without departing from the scope or ambit of the present invention.

For example, the bottom 14 of the sled may have the added capability of temporarily engaging a plurality of wheels, such as omnidirectional wheels, having the desired level of frictional resistance, when it is not desired to exercise by sliding the bottom of the exercise sled on a ground surface.

The reference in this specification to any prior publication (or information derived from it), or to any matter which is known, is not, and should not be taken as an acknowledgement or admission or any form of suggestion that that prior publication (or information derived from it) or known matter forms part of the common general knowledge in the field of endeavour to which this specification relates before the filing date of this patent application.

The invention claimed is:

1. An exercise sled for performing a core strengthening exercise routine, the exercise sled comprising a load bearing body having a bottom which is configured to slide on a ground surface by pushing or pulling by a person performing the exercise routine, a front end which has wall portions configured for receiving the hands, knees or feet of the person, a rear end which has wall portions configured for receiving the feet of the person, an intermediate region between the front and rear ends and which has an elevated portion separating a first ramp portion at a first side of the intermediate region from a second ramp portion at a second side of the intermediate region, wherein each of the first and second ramp portions has a forward facing ramp surface and a rearward facing ramp surface, and wherein a first open recess is located between the wall portions at the front end and the forward facing ramp surfaces, and a second open recess is located between the wall portions at the rear end and the rearward facing ramp surfaces.

2. The exercise sled of claim 1, wherein the wall portions at the front end comprise a pair of wall portions.

3. The exercise sled of claim 1, wherein the wall portions at the rear end comprise a single continuous wall.

4. The exercise sled of claim 1 wherein the rearward facing ramp surface is steeper than the forward facing ramp surface.

5. The exercise sled of claim 1 wherein the intermediate region has a rear surface which has two openings separated by a wall section, the openings having internal passage ways which are interconnected.

6. The exercise sled of claim 5 further comprising an elastically stretchable line which forms a loop around the wall section of the rear surface of the intermediate region after the elastically stretchable line is fed into one of the openings and then exits from the other opening, and the elastically stretchable line has free ends which are connected together around an external anchor point.

7. The exercise sled of claim 1 wherein the front end has a front surface which has two openings separated by a wall section, the openings having internal passageways which are interconnected.

8. The exercise sled of claim 7 further comprising an elastically stretchable line which forms a loop around the wall section of the front surface of the front end after the elastically stretchable line is fed into one of the openings and then exits from the other opening, and the elastically stretchable line has free ends which are connected together around an external anchor point.

9. The exercise sled of claim 1 further comprising a pair of foot straps attached to the rearward facing ramp surfaces.

10. The exercise sled of claim 1 further comprising an opening in one or each of the rearward facing ramp surfaces for inserting into the or each opening a required weight to increase the load of the load bearing body.

* * * * *